US009554676B1

(12) United States Patent
Bisciotti

(10) Patent No.: US 9,554,676 B1
(45) Date of Patent: Jan. 31, 2017

(54) WATER DISPENSER AND DRAIN FOR USE WITH A TOILET

(71) Applicant: Bernard Bisciotti, Port Orange, FL (US)

(72) Inventor: Bernard Bisciotti, Port Orange, FL (US)

( * ) Notice: Subject to any disclaimer, the term of this patent is extended or adjusted under 35 U.S.C. 154(b) by 0 days.

(21) Appl. No.: 14/823,034

(22) Filed: Aug. 11, 2015

(51) Int. Cl.
*E03D 1/00* (2006.01)
*A47K 10/32* (2006.01)
*E03D 9/00* (2006.01)

(52) U.S. Cl.
CPC ..... *A47K 10/32* (2013.01); *E03D 1/003* (2013.01); *E03D 9/00* (2013.01); *A47K 2010/3273* (2013.01)

(58) Field of Classification Search
CPC ..... E03D 5/10
USPC ..... 4/300–442
See application file for complete search history.

(56) References Cited

U.S. PATENT DOCUMENTS 3,090,965 A * 5/1963 Panze ..... A47K 7/08 4/353
3,776,773 A * 12/1973 Taft ..... A47K 10/32 118/325
3,808,608 A * 5/1974 Caplan ..... E03D 9/085 4/448
3,865,271 A * 2/1975 Gold ..... A47K 10/32 221/96
4,451,943 A * 6/1984 Nibler ..... A47K 10/32 134/6
4,667,846 A * 5/1987 Marceau ..... A47K 10/32 221/34
5,044,556 A * 9/1991 Suzuki ..... A47K 10/32 222/183
5,228,152 A * 7/1993 Fraley ..... A47K 4/00 4/664
5,381,568 A * 1/1995 Warkentin ..... E03D 9/06 4/341
D381,396 S 7/1997 Paterson
5,660,313 A * 8/1997 Newbold ..... A47K 10/32 206/205
5,887,759 A * 3/1999 Ayigbe ..... A47K 10/32 118/325
6,076,199 A * 6/2000 Na ..... E03D 9/085 4/420.4
6,357,057 B1 * 3/2002 Krist ..... D06F 41/00 4/255.06
6,675,405 B1 * 1/2004 Harm ..... E03D 9/085 239/282

(Continued)

FOREIGN PATENT DOCUMENTS

WO WO2010077115 A3 10/2010

*Primary Examiner* — Lori Baker
(74) *Attorney, Agent, or Firm* — Kyle A. Fletcher, Esq.

(57) ABSTRACT

The water dispenser and drain for use with a toilet is a device that is used to wet toilet paper. The water dispenser and drain is an accessory that is adapted to be positioned atop of or adjacent to a toilet. Moreover, the water dispenser and drain is adapted to tie into a water line that is associated with said toilet. The water dispenser and drain includes a drainpipe that is adapted to be fed into the toilet tank in order to drain excess water therein. The water dispenser and drain includes a catch basis that includes a drain in fluid connection with the drainpipe. A nozzle is connected to a valve that is in turn in fluid connection with the water line associated with the toilet. The nozzle is positioned directly over the catch basin and drain.

11 Claims, 5 Drawing Sheets

(56) References Cited

U.S. PATENT DOCUMENTS

| | | | | |
|---|---|---|---|---|
| 6,959,890 | B1 * | 11/2005 | Breitinger | A47K 10/38 221/199 |
| 7,162,754 | B2 * | 1/2007 | Haile, Jr. | E03D 1/003 239/282 |
| 7,543,339 | B1 * | 6/2009 | Harris | E03D 9/085 4/420.5 |
| 7,677,410 | B2 * | 3/2010 | Lee | A47K 10/422 221/176 |
| 8,827,116 | B1 * | 9/2014 | Hamilton | A47K 5/1202 222/180 |
| 9,096,996 | B2 * | 8/2015 | Garza Laguera Garza | E03D 1/003 |
| 2010/0223720 | A1 * | 9/2010 | Mehta | E03D 11/025 4/307 |
| 2015/0272404 | A1 * | 10/2015 | Jeon | A47K 10/32 222/173 |

* cited by examiner

WATER DISPENSER AND DRAIN FOR USE WITH A TOILET

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of toilets, more specifically, an accessory for use with a toilet, which dispenses water into a basin, and is positioned on top of the toilet in order to wet toilet paper as needed.

SUMMARY OF INVENTION

The water dispenser and drain for use with a toilet is a device that is used to wet toilet paper. The water dispenser and drain is an accessory that is adapted to be positioned atop of or adjacent to a toilet. Moreover, the water dispenser and drain is adapted to tie into a water line that is associated with said toilet. The water dispenser and drain includes a drainpipe that is adapted to be fed into the toilet tank in order to drain excess water therein. The water dispenser and drain includes a catch basis that includes a drain in fluid connection with the drainpipe. A nozzle is connected to a valve that is in turn in fluid connection with the water line associated with the toilet. The nozzle is positioned directly over the catch basin and drain. The valve includes an actuator armature that descends downwardly and is adapted to be engaged in order for the valve to release water via the nozzle. In use, the water dispenser and drain is adapted to dispense water, which is used to wet toilet paper prior to use.

An object of the invention is to provide an accessory for a toilet, which is able to dispense water that is used to wet toilet paper prior to use.

A further object of the invention is to provide a device that is adapted to tie into a water line of the associated toilet.

Another object of the invention is to collect unused water into a catch basin, and direct said water into a drain, which diverts said water into the toilet tank of the associated toilet.

These together with additional objects, features and advantages of the water dispenser and drain for use with a toilet will be readily apparent to those of ordinary skill in the art upon reading the following detailed description of the presently preferred, but nonetheless illustrative, embodiments when taken in conjunction with the accompanying drawings.

In this respect, before explaining the current embodiments of the water dispenser and drain for use with a toilet in detail, it is to be understood that the water dispenser and drain for use with a toilet is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the water dispenser and drain for use with a toilet.

It is therefore important that the claims be regarded as including such equivalent construction insofar as they do not depart from the spirit and scope of the water dispenser and drain for use with a toilet. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
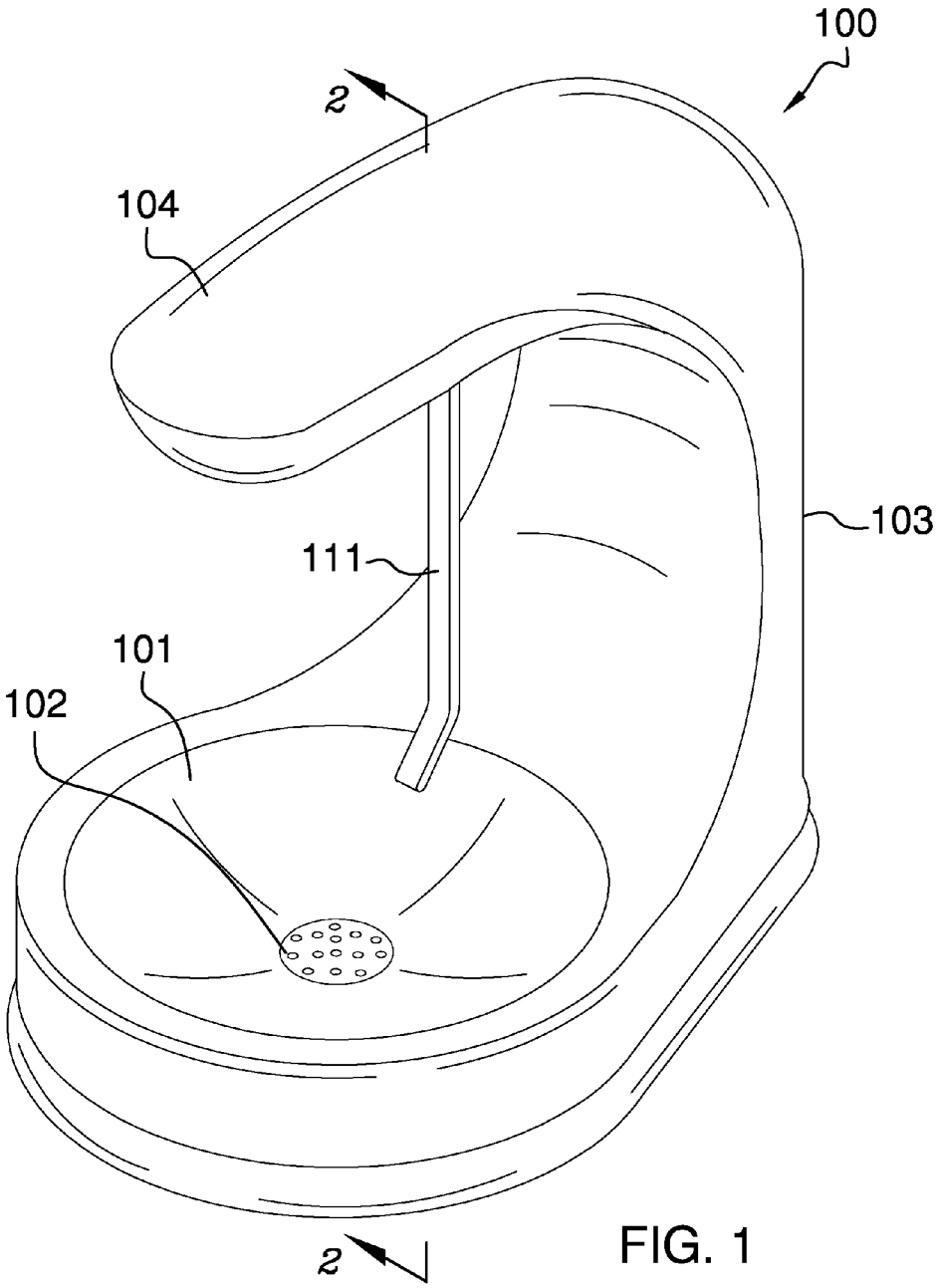
FIG. 1 is a perspective view of an embodiment of the disclosure.
Figure 2:
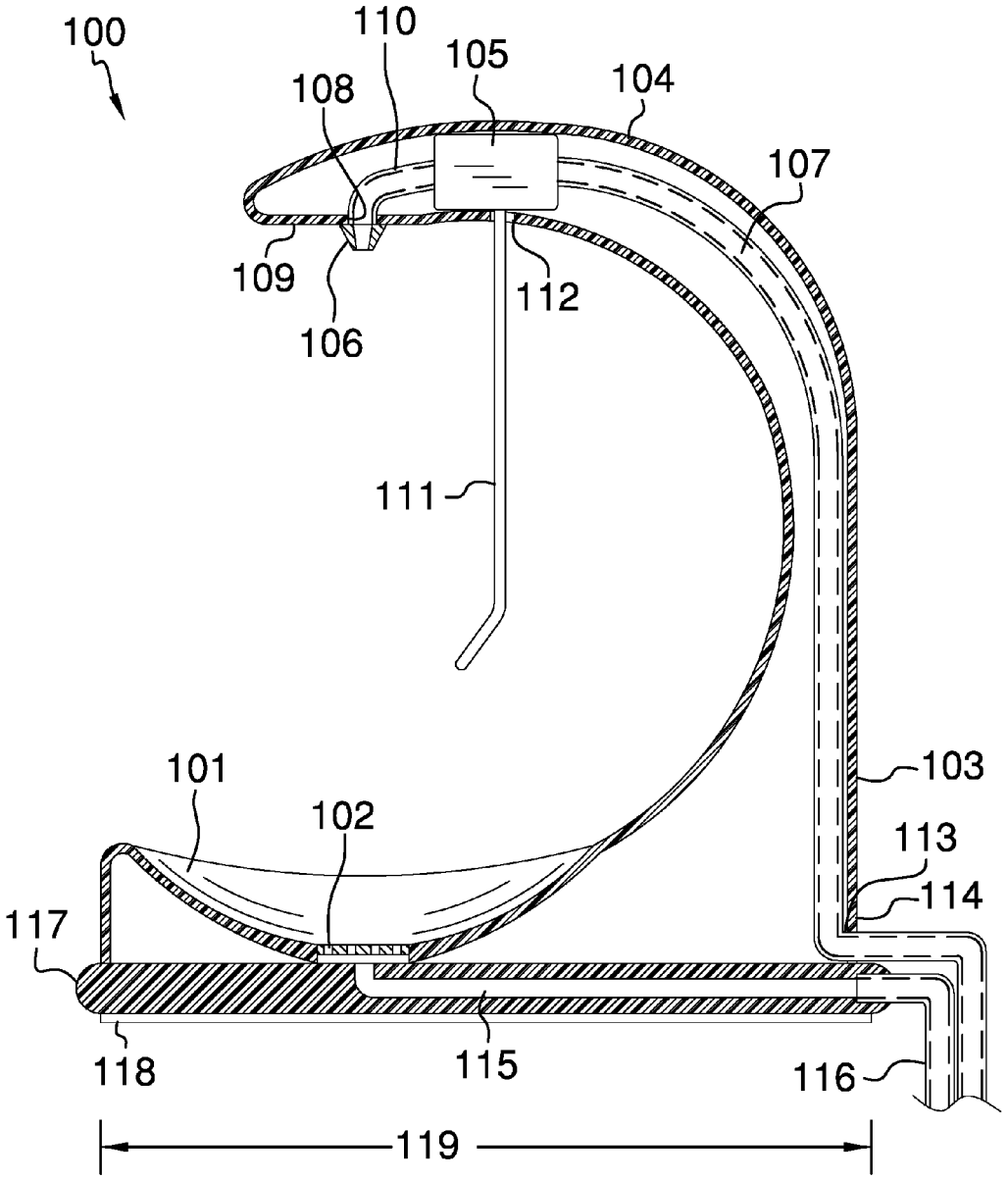
FIG. 2 is a cross-sectional view of an embodiment of the disclosure along line 2-2 in FIG. 1.
Figure 3:
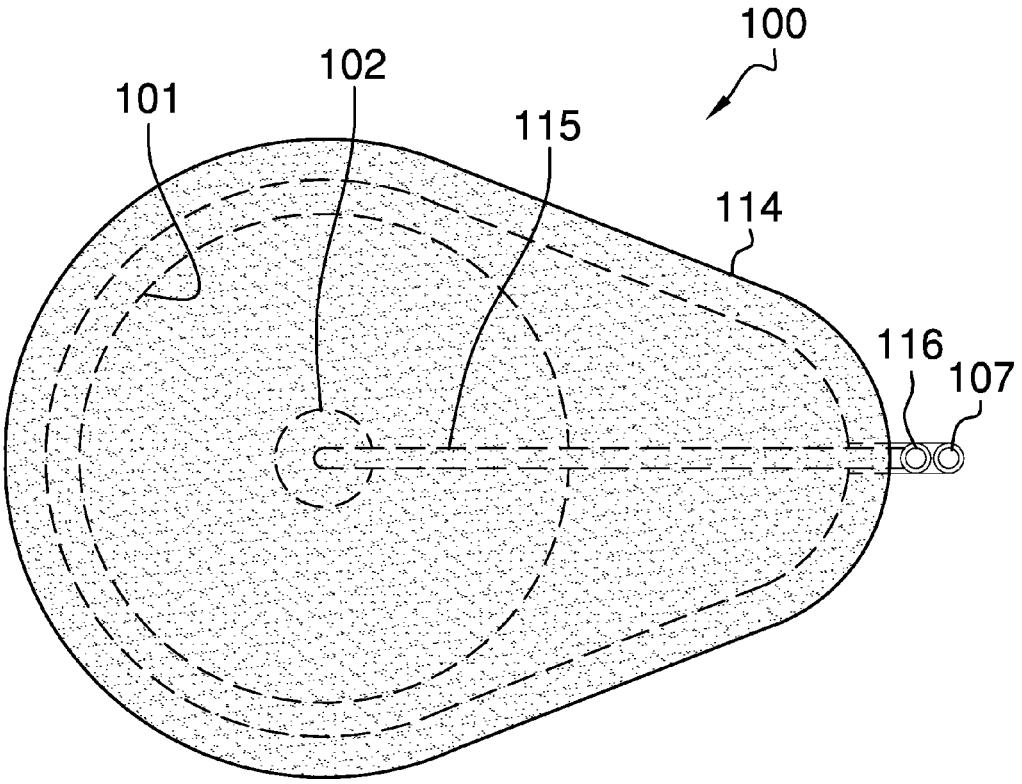
FIG. 3 is a bottom view of an embodiment of the disclosure.
Figure 4:
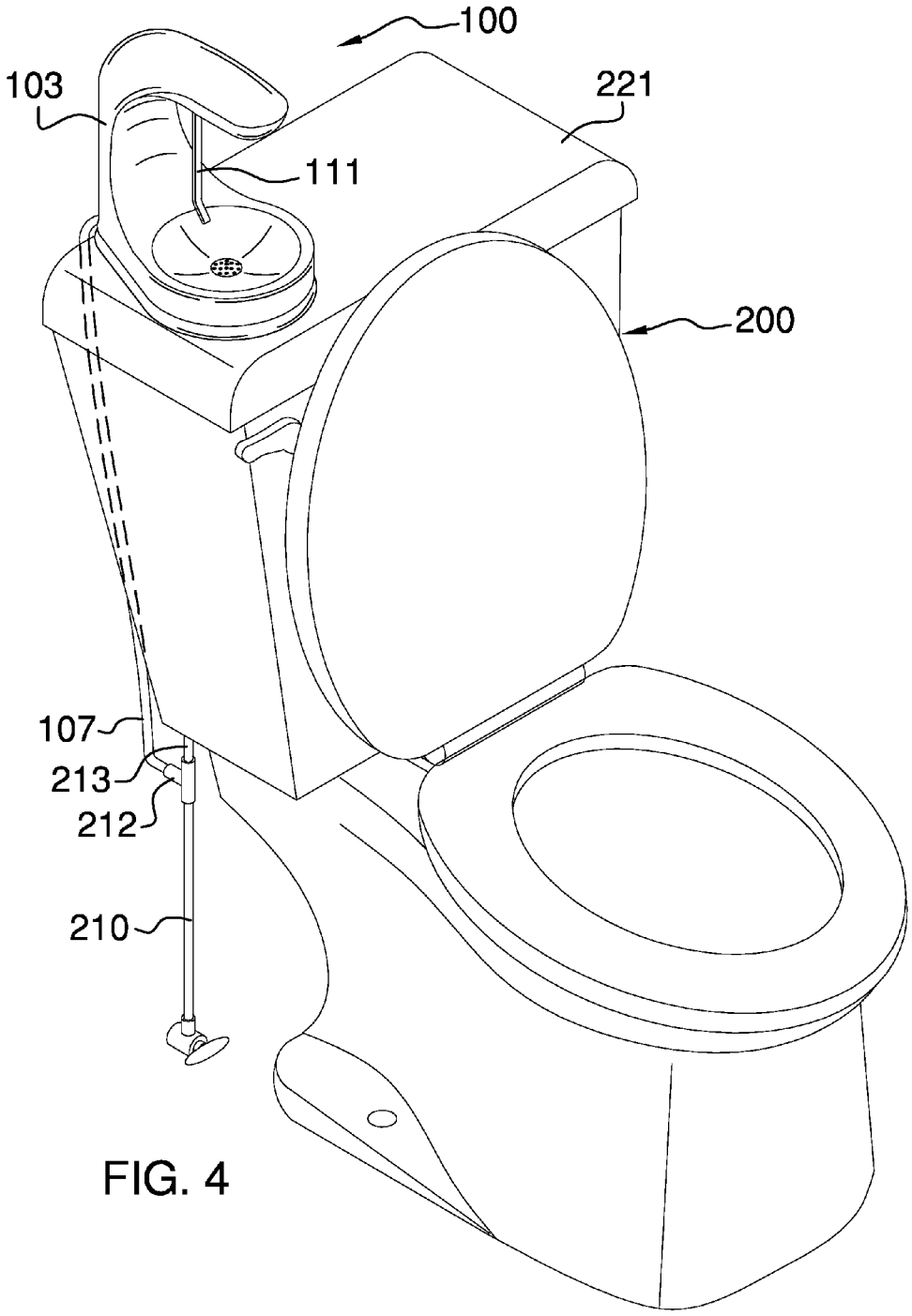
FIG. 4 is a perspective, in-use view of an embodiment of the disclosure.
Figure 5:
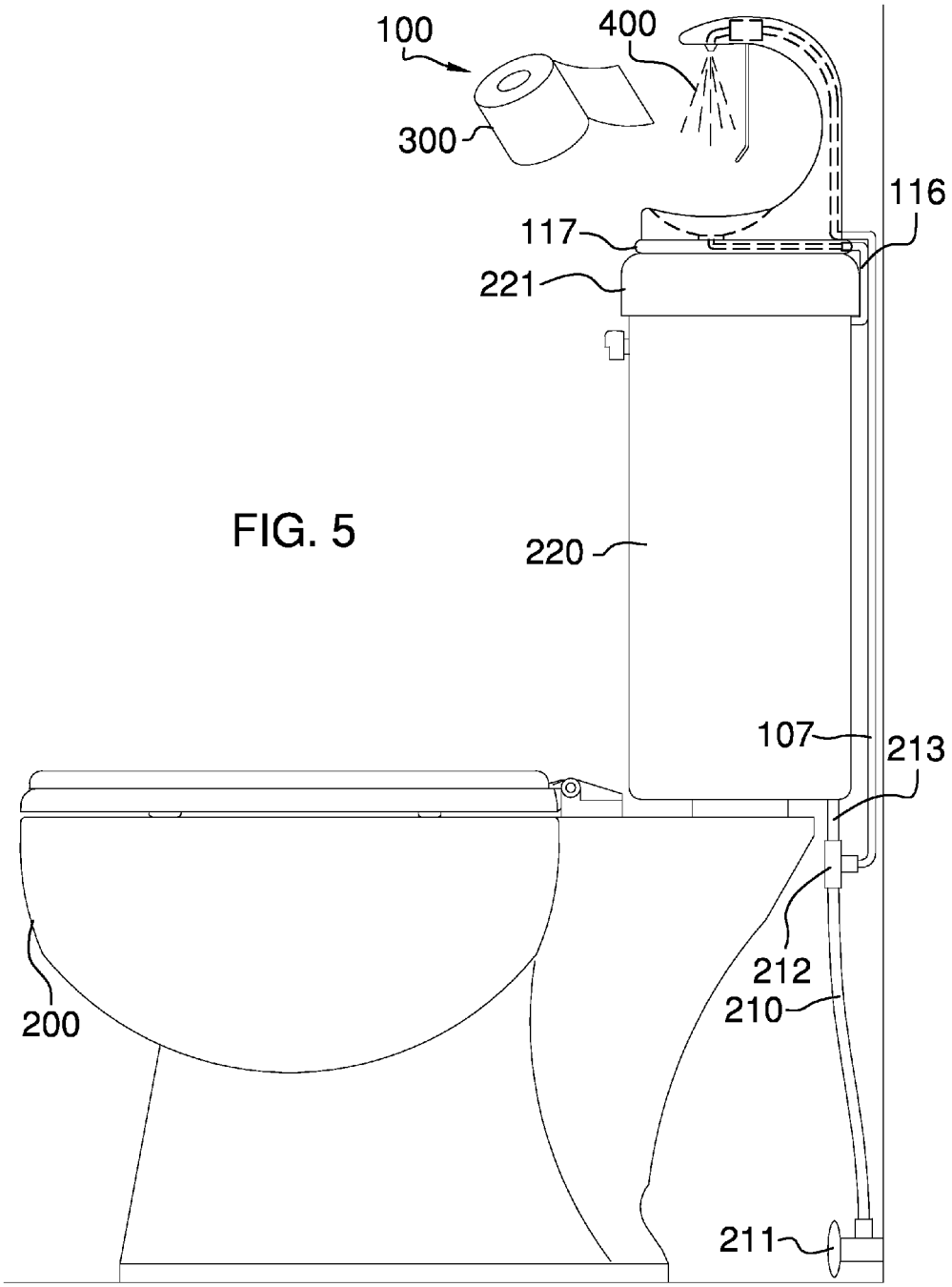
FIG. 5 is side, in-use view of an embodiment of the disclosure.

Detailed reference will now be made to potential embodiments of the disclosure, which are illustrated in FIGS. 1 through 5. The water dispenser and drain for use with a toilet 100 (hereinafter invention) comprises a catch basin 101 that includes a drain 102. The catch basin 101 is a bowl-shaped appendage that is integrated into the design of a housing 103 that is adapted to rest adjacent to or atop of a toilet 200.

The housing 103 includes an armature 104 that extends upwardly from behind the catch basin 101. The armature 104 extends over top of the catch basin 101 as well as the drain 102. The armature 104 is of hollowed construction and includes a valve 105 mounted therein. The valve 105 is in fluid connection between a nozzle 106 and a water line 107. The water line 107 is adapted to tie in with a water source associated with the toilet 200.

The nozzle 106 directs water directly down, and into the catch basin 101. The nozzle 106 extends out of a nozzle opening 108 provided on a bottom armature surface 109 of the armature 104. The nozzle 106 connects with the valve 105 via a nozzle conduit 110 that extends there between. The nozzle conduit 110 is located inside of the armature 104. The valve 105 includes an actuator armature 111. The actuator armature 111 extends downwardly from the valve 105. Moreover, the actuator armature 111 extends through an actuator opening 112 provided on the bottom armature surface 109 of the armature 104. The actuator armature 111 is adapted to be engaged in order to open or close the valve 105. The valve 105 is normally closed, and is opened only upon pushing the actuator armature 111.

The water line 107 extends from the valve 105 through the armature 104, and out a line opening 113 provided on a lower, rear surface 114 of the housing 103. The water line 107 extends downwardly behind the toilet 200. Moreover, the water line 107 is adapted to connect with the water source associated with the toilet 200. The water source is essentially an existing water line 210 that extends from an existing water valve 211. A tee-fitting 212 shall be used to connect the existing water line 210, the water line 107 of the invention 100, and a third water line 213 that actually connects to the toilet 200.

Ideally, the invention 100 is adapted to be seated atop of the toilet 200. Moreover, the housing 103 is adapted to rest atop of a toilet tank 220 of the toilet 200. The toilet tank 220 includes a removable tank lid 221 that the invention 100 is adapted to rest thereon. The invention 100 is able to dispense water that is used to wet toilet paper 300 prior to use.

The drain 102 is in fluid connection with a drain conduit 115 that is integrated into a base portion 117 of the housing 103. The drain conduit 115 extends below the drain 102, and rearwardly of the housing 103. The drain conduit 115 connects with a drain line 116. The drain line 116 exits the housing 103, and extends downwardly there from. The drain line 116 is adapted to be fed into the toilet tank 220 under the removable tank lid 221. In use, the invention 100 directs unused water 400 down the drain 102, and into the toilet tank 220 via the drain line 116 so that no water is spilled or wasted.

The housing 103 and the base portion 117 may be made of a material comprising a ceramic, plastic, metal, wood, carbon fiber composite. The invention 100 requires only a minimal amount of retrofitting in order to be operationally coupled with the existing water line 210 and the toilet 200. The overall size and weight of the housing 103 is minimal, and should be sized to fit atop of the removable tank lid 221. The base portion 117 may include a rubber pad 118 to provide enhanced traction when seated atop of the toilet 200. The base portion 117 is further defined with a base length 119. The base length 119 need not be more than 10 inches, and shall vary depending on embodiments suitable designed for use with different sized toilets 200.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

Is shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A water dispenser and drain for use with a toilet comprising:

a housing that is adapted to be positioned adjacent a toilet;

wherein the housing is able to dispense water in order to adaptively wet toilet paper;

wherein the housing derives water from a water source associated with said toilet;

wherein the housing includes a catch basin;

wherein the catch basin includes a drain;

wherein the catch basin is a bowl-shaped appendage that is integrated into the design of the housing;

wherein the housing includes an armature that extends upwardly from behind the catch basin;

wherein the armature extends over top of the catch basin as well as the drain;

wherein the armature is of hollowed construction and includes a valve mounted therein;

wherein the valve is in fluid connection between a nozzle and a water line; wherein the water line is adapted to tie in with the water source associated with the toilet;

wherein the nozzle directs water directly down, and into the catch basin;

wherein the nozzle extends out of a nozzle opening provided on a bottom armature surface of the armature; wherein the nozzle connects with the valve via a nozzle conduit that extends there between.

2. The water dispenser and drain for use with a toilet according to claim 1 wherein the nozzle conduit is located inside of the armature; wherein the valve includes an actuator armature; wherein the actuator armature extends downwardly from the valve.

3. The water dispenser and drain for use with a toilet according to claim 2 wherein the actuator armature extends through an actuator opening provided on the bottom armature surface of the armature; wherein the actuator armature is adapted to be engaged in order to open or close the valve; wherein the valve is normally closed, and is opened only upon pushing the actuator armature.

4. The water dispenser and drain for use with a toilet according to claim 3 wherein the water line extends from the valve through the armature, and out a line opening provided on a lower, rear surface of the housing.

5. The water dispenser and drain for use with a toilet according to claim 4 wherein water line extends downwardly behind the toilet; wherein the water line is adapted to connect with an existing water line that extends from an existing water valve; wherein a tee-fitting is used to connect the existing water line, the water line, and a third water line that connects to the toilet.

6. The water dispenser and drain for use with a toilet according to claim 5 wherein the housing is adapted to rest atop of a toilet tank of the toilet; wherein the toilet tank includes a removable tank lid that the housing is adapted to rest upon.

7. The water dispenser and drain for use with a toilet according to claim 6 wherein the drain is in fluid connection with a drain conduit that is integrated into a base portion of the housing.

8. The water dispenser and drain for use with a toilet according to claim 7 wherein the drain conduit extends below the drain, and rearwardly of the housing; wherein the drain conduit connects with a drain line; wherein the drain line exits the housing, and extends downwardly there from.

9. The water dispenser and drain for use with a toilet according to claim 8 wherein the drain line is adapted to be fed into the toilet tank under the removable tank lid; wherein unused water is directed down the drain, and into the toilet tank via the drain line.

10. The water dispenser and drain for use with a toilet according to claim 9 wherein the base portion includes a rubber pad to provide enhanced traction when seated atop of the toilet.

11. The water dispenser and drain for use with a toilet according to claim 10 wherein the base portion is further defined with a base length, which shall be no longer than 10 inches.

* * * * *